US006012246A

United States Patent [19]

Robinson et al.

[11] Patent Number: 6,012,246

[45] Date of Patent: Jan. 11, 2000

[54] BUTTSTOCK FOR FIREARM WITH AMBIDEXTROUS SLING ATTACHMENT AND REMOVABLE BUTT PLATE

[75] Inventors: Alexander J. Robinson, Salt Lake City; Darin G. Nebeker, Layton, both of Utah

[73] Assignee: ZDF Import Export Inc., Salt Lake City, Utah

[21] Appl. No.: 09/013,072

[22] Filed: Jan. 26, 1998

[51] Int. Cl.[7] ..... F41C 23/20; F41C 23/22

[52] U.S. Cl. ..... 42/71.01; 42/75.03

[58] Field of Search ..... 72/71.01, 73, 74, 72/75.03

[56] References Cited

U.S. PATENT DOCUMENTS

| | | | |
|---|---|---|---|
| 2,484,168 | 10/1949 | Jachimiec | 42/71.01 |
| 2,498,749 | 2/1950 | Benson | 42/71.01 |
| 3,618,248 | 11/1971 | Into et al. | 42/71.01 |
| 3,665,632 | 5/1972 | Ford | 42/71.01 |
| 3,852,904 | 12/1974 | Drevet | 42/74 |
| 4,024,819 | 5/1977 | Schirneker . | |
| 4,290,220 | 9/1981 | Ruger | 42/71.01 |
| 4,512,101 | 4/1985 | Waterman, Jr. | 42/71.01 |
| 4,685,237 | 8/1987 | Hugg | 42/85 |
| 4,850,127 | 7/1989 | Davis et al. | 42/71.01 |
| 4,896,446 | 1/1990 | Gregory | 42/73 |
| 4,934,084 | 6/1990 | Thomas | 42/71.01 |
| 5,068,991 | 12/1991 | Reed | 42/71.01 |
| 5,075,995 | 12/1991 | Kennel | 42/73 |
| 5,615,508 | 4/1997 | Miller et al. | 42/71.01 |
| 5,711,102 | 1/1998 | Plaster et al. | 42/73 |
| 5,752,339 | 5/1998 | Bentley et al. | 42/74 |

FOREIGN PATENT DOCUMENTS

| | | | |
|---|---|---|---|
| 1439718 | 4/1966 | France | 42/71.01 |
| 119643 | 9/1947 | Sweden | 42/71.01 |

OTHER PUBLICATIONS

Hatcher, American Rifleman, New Air Force Weapons, Apr. 1951, pp. 50–51.

*Primary Examiner*—Stephen M. Johnson
*Attorney, Agent, or Firm*—Lloyd W. Sadler

[57] ABSTRACT

A buttstock is described which contains an enclosure for storage of tools and parts, and which is totally accessible to the user through a butt plate held in place by a removable pin. This buttstock invention also has a sling attachment device which is designed to be positionable on either side of the buttstock, for either left or right side carrying and which cooperates with the butt plate pin to hold each in position. The sling attachment devices is relocatable with mounting points at various places on the stock to permit multiple user carrying styles. This invention affords assembly and disassembly without the use of special tools and therefore can be easily done by the user in the field. This invention is also preferably composed of a strong light weight material which is adapted for ease of use, is non-corrosive, and supports low cost manufacture. Easily attachable to a wide variety of firearms, cross bows, scopes and other aimed devices, this invention provides important features for ease of use and is innovative in its combination and cooperation of its components and features.

2 Claims, 6 Drawing Sheets

BUTTSTOCK FOR FIREARM WITH AMBIDEXTROUS SLING ATTACHMENT AND REMOVABLE BUTT PLATE

BACKGROUND OF THE INVENTION

1. Field of the Invention

This invention relates to stocks or buttstocks that are used to provide support for rifles, shotguns, air guns, crossbows, and similar aimed devices. More specifically, this invention relates to buttstocks which are adapted to provide user access to the buttstock's interior for storage of tools and other devices and which provide a mechanism for attaching a sling to the buttstock for ease of carrying the firearm.

2. Description of Related Art

A variety of firearms have used stocks to store tools, cleaning equipment and spare parts. Typically such stocks are composed of wood or plastic and have a trap door. The trap door, in turn, is generally fabricated from several parts, including: a door, a hinge, and a latch. It is also well known in the art to attach a sling to the buttstock of a rifle. Generally, such a sling is fixed to a single position on the buttstock. Prior buttstocks and sling attachments typically either do not allow access to the entire stock cavity and if they permit the sling attachment to be relocated, they require special tools for relocation of the sling attachment. Also, prior buttstocks, due to the materials used and the number of parts and fittings, are relatively expensive to manufacture and/or assemble.

For general background material, the reader is directed to U.S. Pat. Nos. 4,685,237, 4,850,127, 4,896,446, 5,068,991, 5,075,995, and 5,615,508, each of which is hereby incorporated by reference in its entirety for the material disclosed therein.

SUMMARY OF THE INVENTION

It is desirable to provide a buttstock for a firearm or other aimed device, which is inexpensive to produce, easy to assemble or disassemble, and which provides both an easily accessible storage area within the buttstock, and an ambidextrous sling attachment.

Therefore, it is the general objective of this invention to provide a buttstock for a rifle or other aimed device which is adapted to provide a storage space for tools or other parts within the buttstock.

It is a further objective of this invention to provide a buttstock which has an interior cavity which can be easily accessed and secured without requiring the use of special tools, thereby permitting the user to have easy access to the interior of the buttstock in the field.

It is a further objective of this invention to provide a buttstock having storage space which is easily accessible without special tools by the user.

Another objective of this invention to provide a buttstock which is adapted to receive a sling attachment on more than one side of the stock.

It is a still further objective of this invention to provide a buttstock which can be inexpensively manufactured and assembled.

It is a yet further objective of this invention to provide a buttstock which is composed of light weight and durable material and which provides full access to the interior of the buttstock.

These and other objectives of this invention will be readily apparent to the to those of ordinary skill in the art upon reading the description and claims of this patent disclosure.

The objectives of this invention are achieved, in its best mode of operation, by an injection molded plastic stock and butt plate, a sling attachment and a detent pin. The butt plate is completely insertable into the stock, with slots on the butt plate lining up with corresponding slots in the stock. The sling attachment plate is inserted in either the right or left side of the stock. Alternative embodiments of this invention allow the insertion of the swing attachment plate into either the top or the bottom of the stock. The sling attachment plate is held in place by a detent pin which is inserted through a hole in the base of the butt plate and through a hole in the sling attachment plate. The detent pin has a ball or spring which is depressed into the pin as it is inserted in the hole in the butt plate, and is pushed through a corresponding hole in the sling attachment plate. As the detent pin head is pushed completely through the buttplate and the sling attachment plate, the detent pin spring or ball is allowed to expand into a cavity, thereby preventing the detent pin from falling out. The detent pin serves to both hold the sling attachment plate in place while the sling attachment plate simultaneously holds the butt plate over the opening of the stock. The use of the common detent pin permits the easy access to the buttstock cavity.

DETAILED DESCRIPTION OF THE INVENTION

This invention is an improved buttstock for rifles, shotguns, cross bows and other aimed devices. This invention addresses several problems and provides solutions. Users of firearms often must carry tools and/or spare parts, a convenient locations for storage of such items is desirable. Users of firearms often prefer carrying the gun by a carrying sling, however many guns provide little if any flexibility in how the firearm is carried. Also, users of firearms generally prefer light weight guns while simultaneously requiring that the firearm is composed of strong and durable materials. This invention addresses these issues by providing a buttstock having (1) a shell which surrounds an easily accessible interior cavity for storage of tools and/or spare parts; (2) a sling attachment plate which can be simply and easily attached to either the right side, the left side, or in alternative embodiments, the top or bottom of the stock; and (3) a selected material which has the characteristics of being light weight, strong, durable, and inexpensive to manufacture and assemble.

Figure 1:
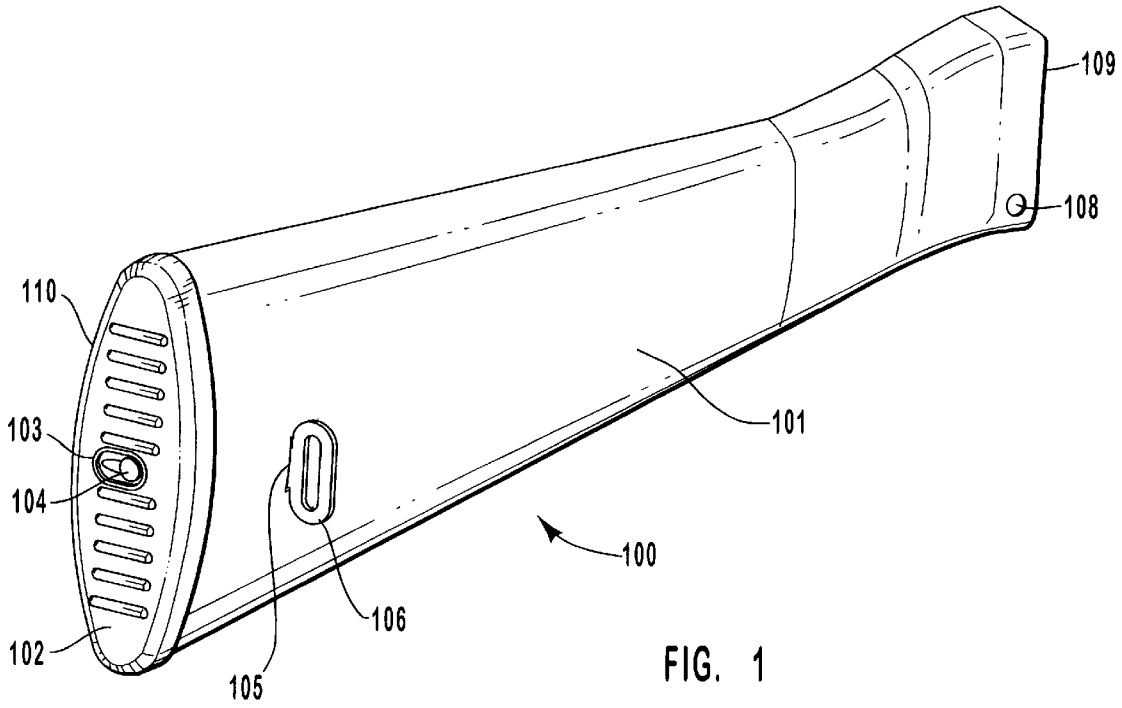
FIG. 1 depicts a perspective drawing of a fully assembled preferred embodiment of the invention.

FIG. 1 depicts a perspective drawing of a fully assembled preferred embodiment of the invention 100. The buttstock 101 is shown adapted with an attachment end 109 where the buttstock 101 can be affixed to a rifle or other aimed device.

The attachment end 109 is provided with a pin aperture 108 for receiving an attachment pin for fixing the buttstock 101 to a rifle or other aimed device. A sling attachment plate 106 is attached to the buttstock 101 via a sling attachment slot 105. The shoulder end 110 of the buttstock 101 is shown with the butt plate 102 inserted. The butt plate 102 is held in place by the sling plate attachment 106 fitted through the sling attachment slot 105. The sling attachment plate 106 is held in place by fitting the detent pin 104 through both the butt plate 102 and the sling attachment plate 106. In the preferred embodiment of the invention the buttstock 101 and the butt plate 102 are manufactured using fiber and mineral reinforced injection molded plastic. However, alternative materials could also be used without departing from the concept of this invention. Such materials include: wood, plastic, metal, composites and the equivalent. The preferred material for the sling attachment plate 106 is sheet metal, which is blanked and formed to form the required shape. The preferred pins 104 are standard detent pins which have a spring or detent ball for holding the pin in place.

Figure 2:
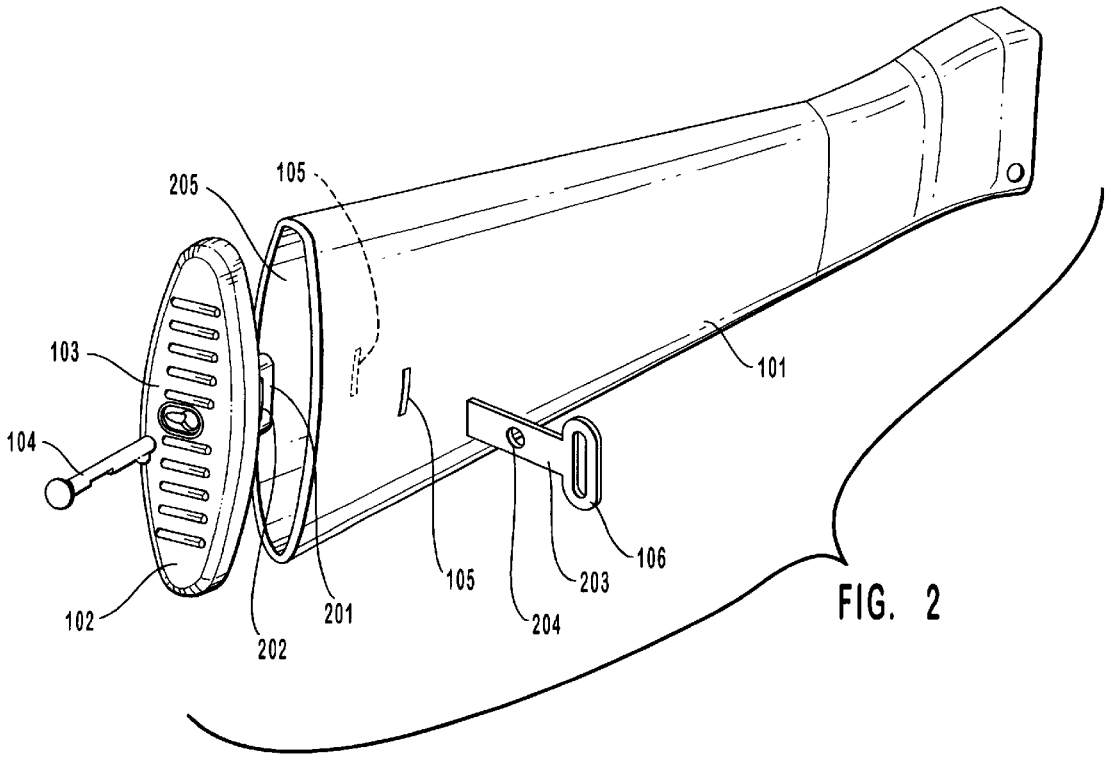
FIG. 2 depicts a perspective drawing of a fully disassembled preferred embodiment of the invention.
Figure 3A:
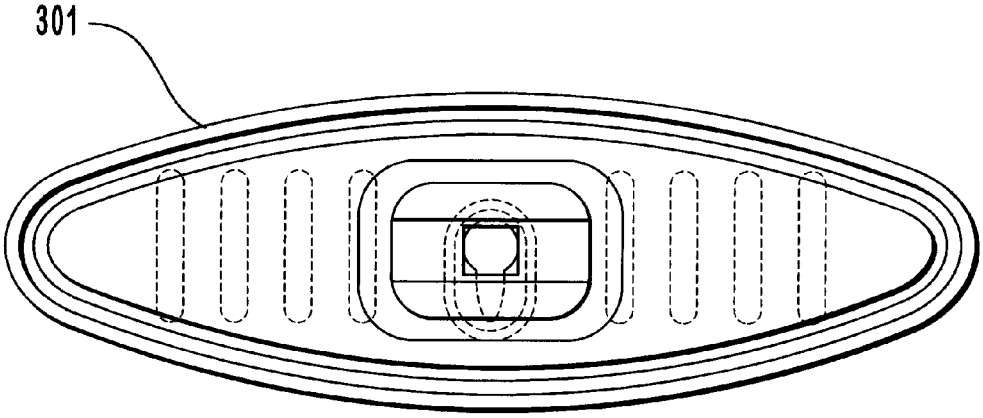
FIG. 3 depicts a detailed drawing of several views of the preferred embodiment of the butt plate component of the invention.
Figure 3B:
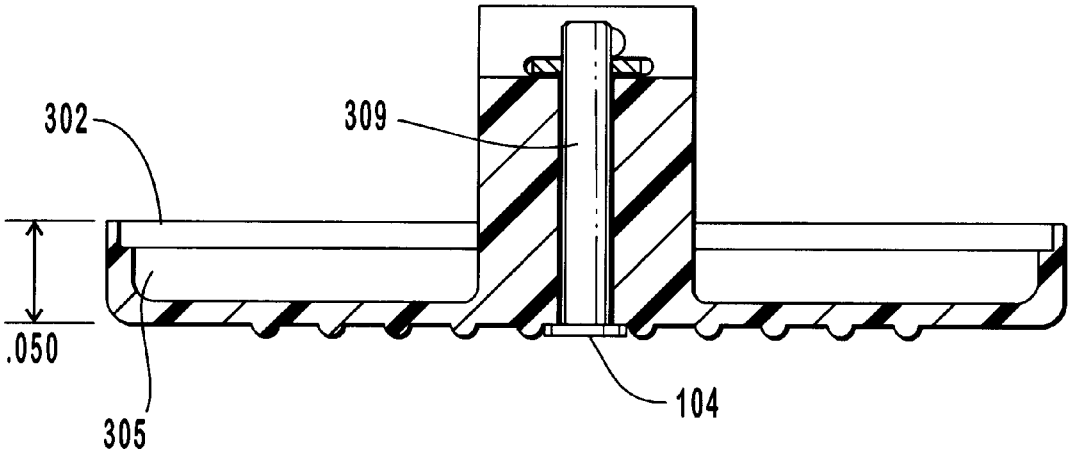
Figure 3C:
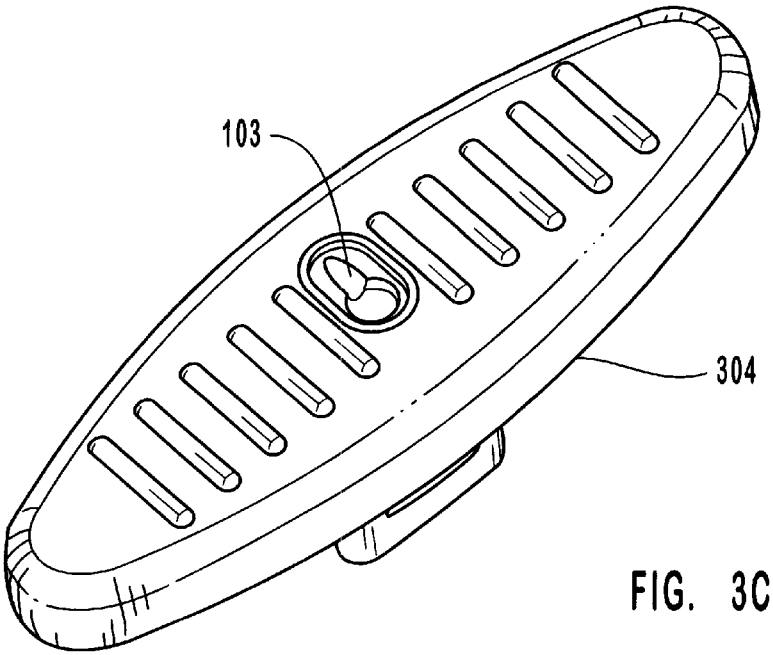
Figure 3D:
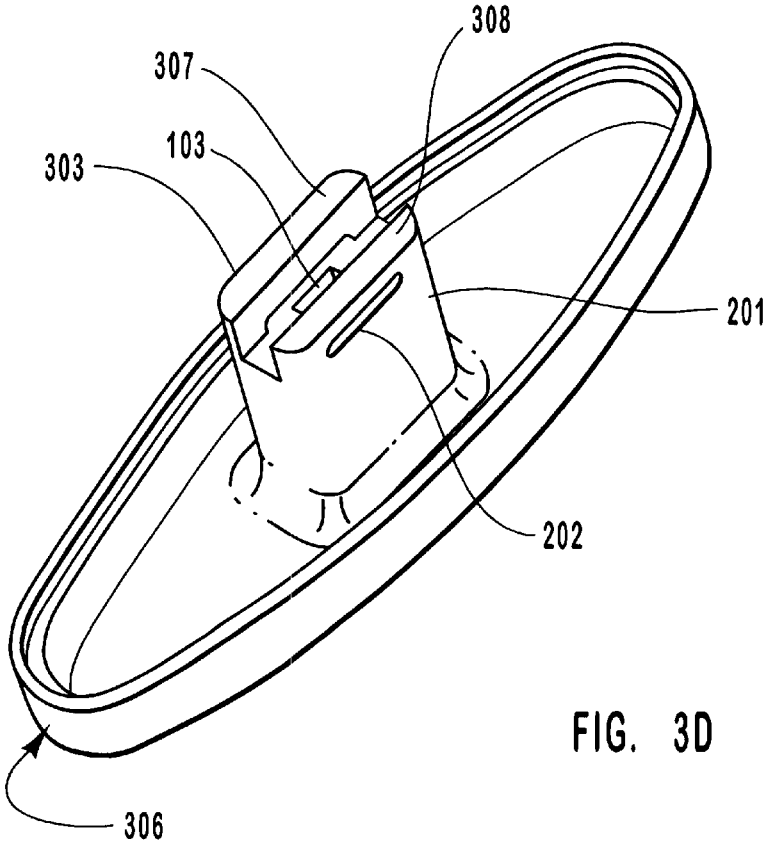
Figure 4A:
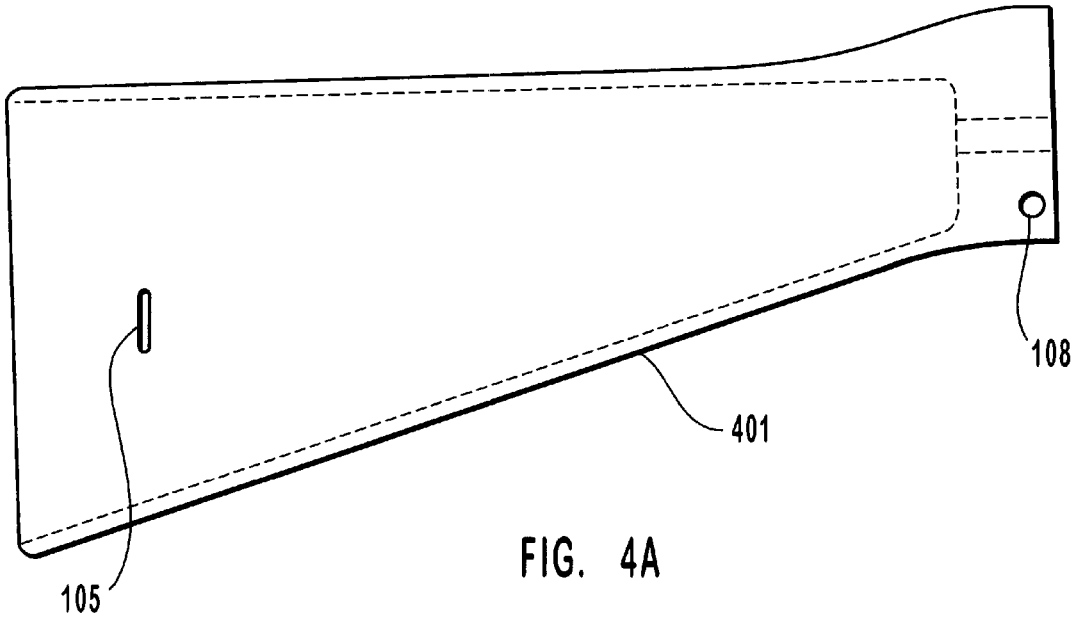
FIG. 4 depicts a detailed drawing of several views of the preferred embodiment of the stock component of the invention.
Figure 4B:
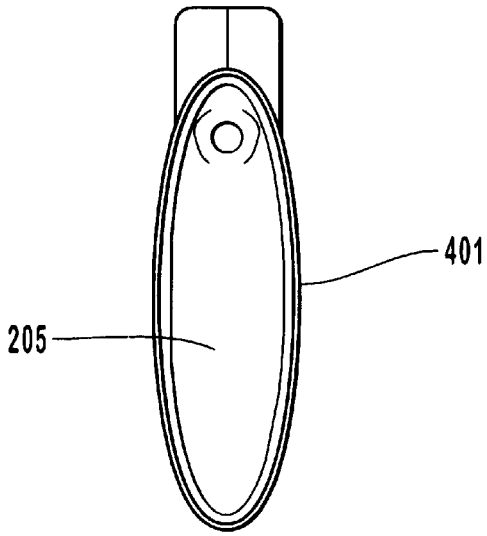
Figure 4C:
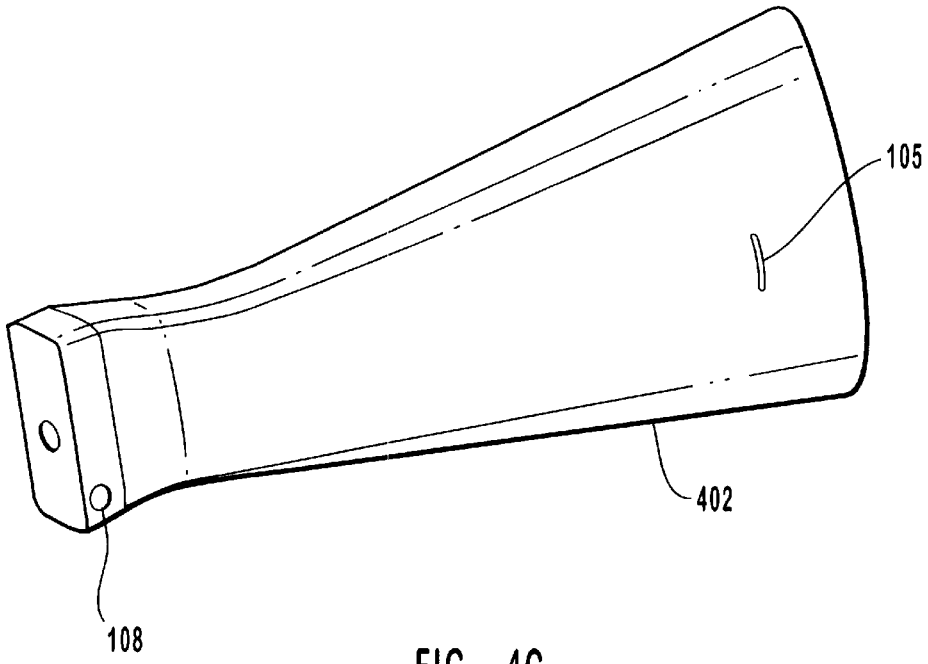
Figure 4D:
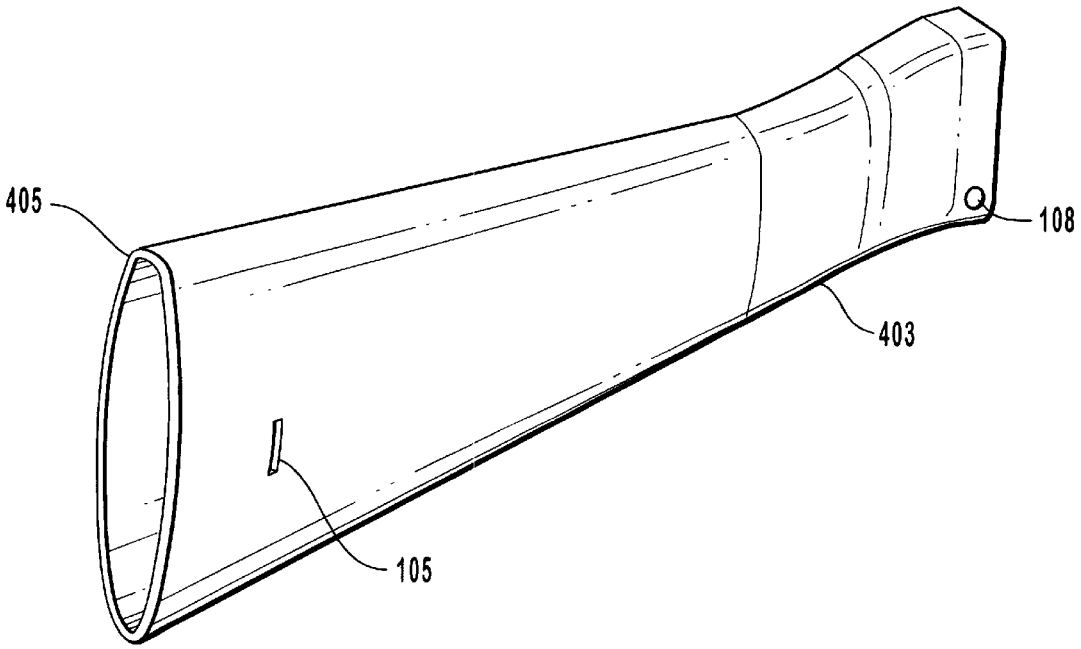

FIG. 2 depicts a perspective drawing of a fully disassembled preferred embodiment of the invention. The sling attachment plate 106 is shown withdrawn from the sling attachment slot 105, exposing an insertion tab 203 having a detent pin retention hole 204 for receiving the detent pin 104. Additional detail on the butt plate 102 is shown with the sling attachment slot fixture 201 having a slot 202 for receiving and securing the sling attachment plate 106. Also shown is the buttstock shell 101 which defines the cavity 205, wherein the user can store tools and parts and which are secure due to the attachment of the butt plate 102.

FIG. 3 depicts a detailed drawing of several views of the preferred embodiment of the butt plate 102 component of the invention. The side view 302 of the butt plate is shown with a cut-away that shows the detent pin 104 installed. The interior 303 of the butt plate 102 is shown, providing additional detail on the sling attachment slot fixture 201 and slot 202. The slot 202 is designed to receive the sling attachment insertion tab 203 with the pin retention hole 204 centered between the two legs 307, 308 of the slot fixture 201. The retention pin hole 103 also extends to a point between the two legs 307, 308. When installed, the detent pin 104 is positioned into butt plate 102 through the retention pin hole 103, and through the sling attachment plate 106 pin retention hole 204 where it is secured, a pin catch 309 within which the detent ball is extendable. A perspective end views 304, 306 are also shown providing detail of the preferred embodiment of the end plate 102.

FIG. 4 depicts a detailed drawing of several views of the preferred embodiment of the stock shell 101 component of the invention. A second perspective view 403 is also provided giving additional detail of the cavity end 405. A end view 404 showing the buttstock cavity 205 is also given.

Figure 5:
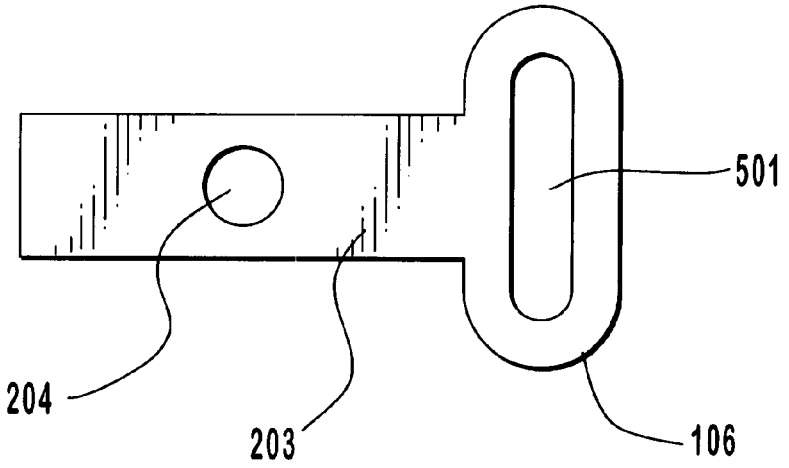
FIG. 5 depicts a detailed drawing of the preferred embodiment of the sling attachment plate.

FIG. 5 depicts a detailed drawing of the preferred embodiment of the sling attachment plate 106. A sling loop 501 is shown. In use a carrying sling is drawn through the sling loop 501 to provide an attachment point for the user in carrying the firearm or other aimed device.

Figure 6:
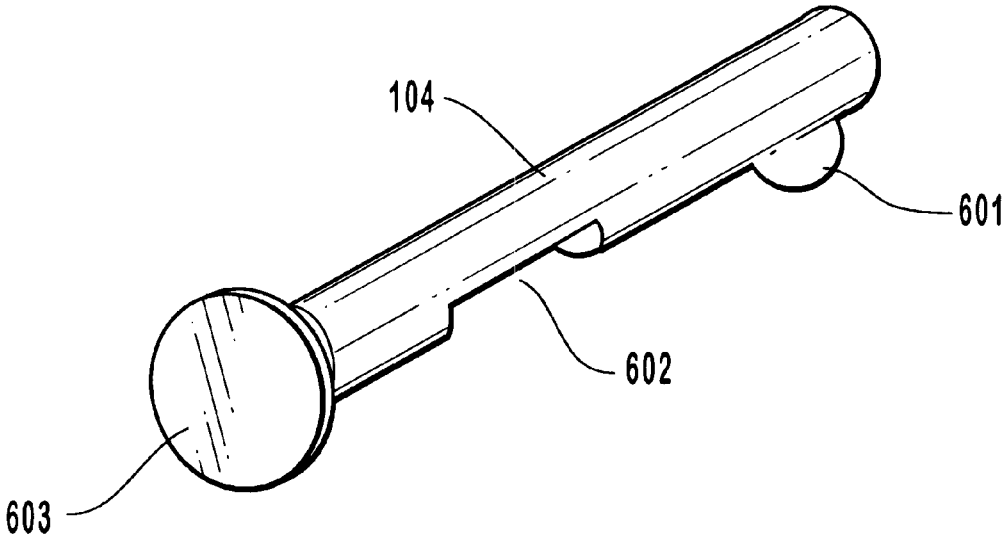
FIG. 6 depicts a detailed drawing of the preferred detent pin.

FIG. 6 depicts a detailed drawing of the preferred detent pin. In the preferred embodiment of the invention, the detent pin 104 is a commercially available part. Important features of the pin are the head 603, which is used to insert or withdraw the pin from the buttstock, the retractable ball or spring 601, which is used to engage and hold the pin in place, and a notch 602 which can engage with a roll pin to keep the pin from being completely removed.

As noted above, an alternative embodiment of the invention would provide the sling attachment plate installation on either the top or the bottom of the buttstock. In this embodiment, the slots in the buttstock 101 and the end plate 102 would run through the stock from top to bottom rather than from side to side.

The described embodiment is to be considered in all respects only as illustrative of the best and preferred mode of the invention, and is not to be considered as restrictive. Although the embodiment described herein uses sizes, orientations and materials, this invention is not limited thereto. Alternative embodiments can be easily be envisioned by those of ordinary skill in the art and can be used in an equivalent manner. The scope of the invention is, therefore, indicated by the appended claims rather than by the foregoing description. All devices which come within the meaning and range of equivalency of the claims are to be embraced within their scope.

We claim:

1. A buttstock, comprising:

(A) a shell having a sling attachment opening wherein said shell has an opening to a storage cavity, a first side and a second side and wherein said sling attachment opening extends through said first side of said shell and said second side of said shell; and (B) a sling attachment plate adapted to be received into said sling attachment opening, wherein said sling attachment plate attachable, in cooperation with said sling attachment opening, to either said first side of said shell or said second side of said shell, and wherein said sling attachment plate further comprises an insertion tab to fit in a slot in an attachment slot fixture of a butt plate and a pin retention hole for receiving a pin for holding said butt plate in said storage cavity opening in said shell.

2. A buttstock, comprising (A) a shell defining an enclosure;

(B) a sling attachment attachable to said shell through an opening in said shell;

(C) a butt plate, said butt plate, having an interior side, an exterior side and an attachment slot fixture protruding from interior side of said butt plate and wherein said butt plate and said attachment slot fixture are composed of the same single composite material, said butt plate attached to said shell by said sling attachment which cooperates with a pin to lock said butt plate in position thereby covering said enclosure; and (D) a means of attaching said buttstock to an aimed device.

* * * * *